United States Patent [19]

Ralston

[11] Patent Number: 4,829,870

[45] Date of Patent: May 16, 1989

[54] ELECTRIC GUITAR

[76] Inventor: Roy A. Ralston, 318½ Main St., Granttown, W. Va. 26574

[21] Appl. No.: 175,491

[22] Filed: Mar. 30, 1988

[51] Int. Cl.[4] ..... G10D 1/08

[52] U.S. Cl. ..... 84/291; 84/293

[58] Field of Search ..... 84/267, 291, 293

[56] References Cited

U.S. PATENT DOCUMENTS 4,188,850 2/1980 Kaman ..... 84/291

4,538,497 9/1985 Smith ..... 84/291

*Primary Examiner*—Lawrence R. Franklin

[57] ABSTRACT

An electric guitar has a lighter weight and a smaller body thickness profile than electric guitars in predominant use today, while maintaining superior sustain and tonal qualities. Favorable inertial environments are constructed to enhance the sustain and tonal qualities of the guitar, by firmly securing a metal plate on the top of the guitar body surface, on the area surrounding the string fastening means at the body end, then firmly securing a second metal plate on the top of the guitar head surface, on the area of the string fastening means at the head end.

9 Claims, 5 Drawing Sheets

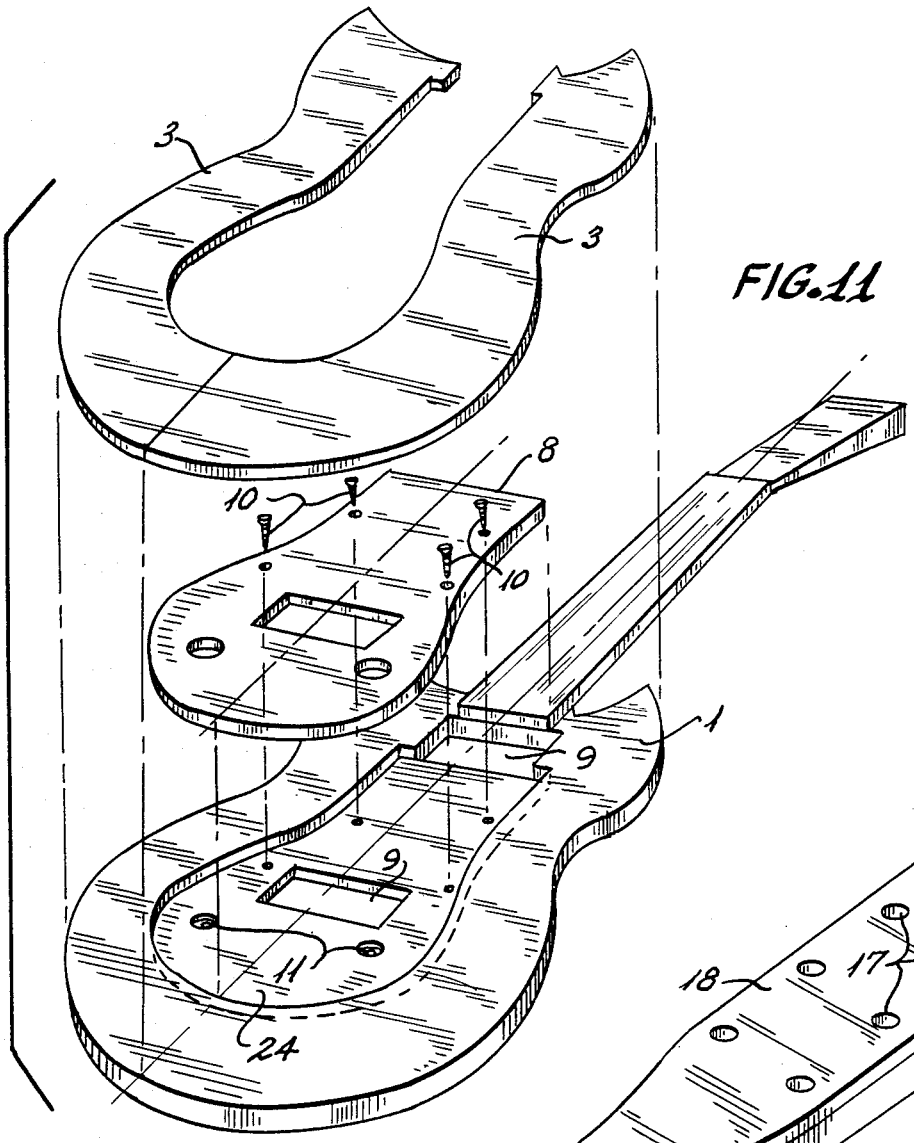
FIG. 11
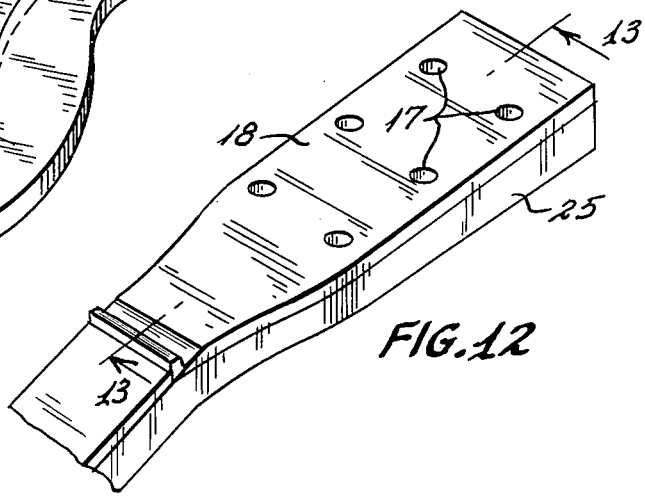
FIG. 12
FIG. 13
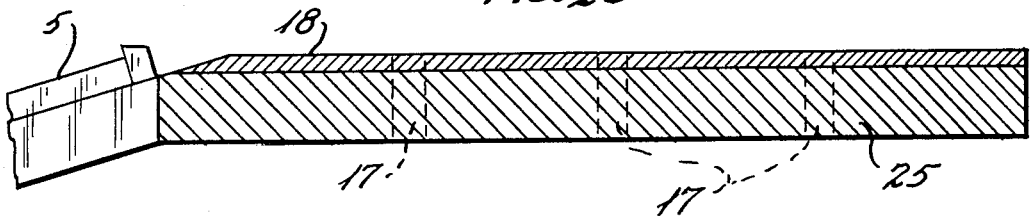

FIG. 14
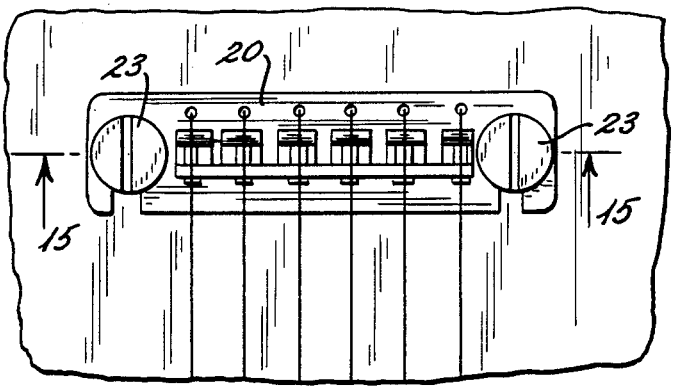
FIG. 15
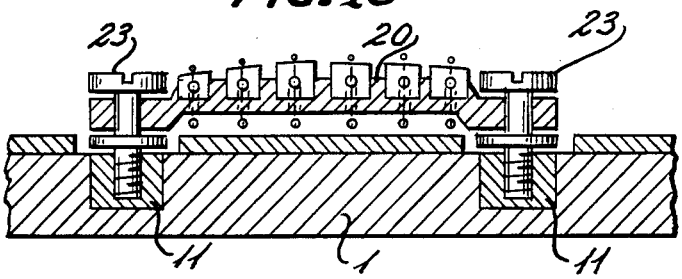
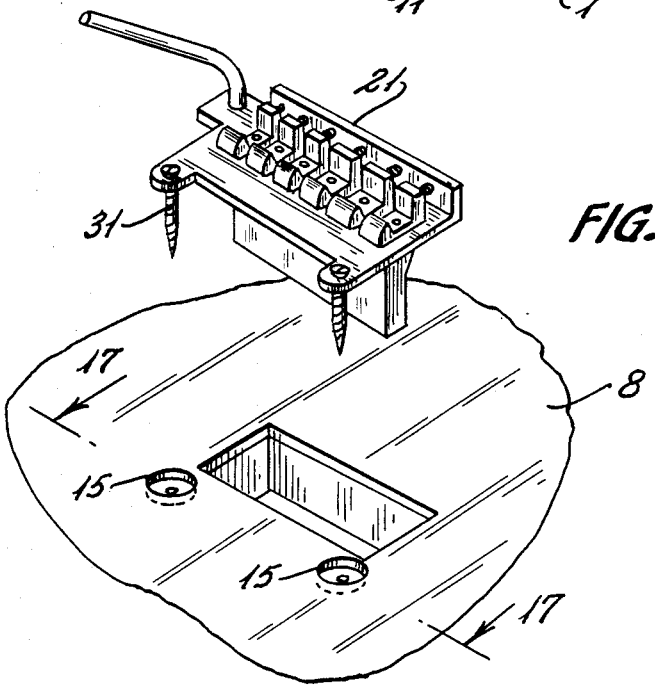
FIG. 16
FIG. 17
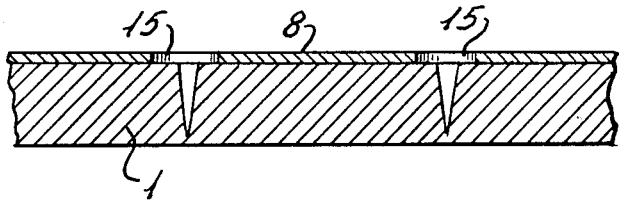

ELECTRIC GUITAR

BACKGROUND OF THE INVENTION

Prior art repeatedly bears witness to the belief that increased use of metal parts, such as, necks, bodies, nuts, etc., improves sustain and tonal qualities, when used in the construction of electric guitars. Unitary metal construction of guitar parts or wholes increases the accuracy of electronic tone and improves the sustain of string vibrations. It is known that uses of denser woods in constructing electric guitars, improves the sustain qualities and tonal qualities of such instruments.

Along with the foregoing improvements in the electric guitar, explained above, have come a new set of problems. Using metal in construction of electric guitars, has caused a cold feel to the instrument, as well as an added cost to construct coverings where hands touch the instrument most. Guitar strings stretched acrossed long expanses of metal may experience difficulty staying at set tunings, with temperature changes. Denser woods used in electric guitar construction, to effect better sustain and tone qualities, adds more weight, while not achieving the same results as obtained by use of metal construction. Electric guitars in predominant use today, that are considered to have adequate sustain and tone qualities, commonly have profiles of up to nearly two inches of body thickness.

SUMMARY OF THE INVENTION

The object of the present invention is to alleviate the aforementioned problems that have arisen, in association with improving sustain and tone qualities in electric guitars. In achieving this desired object, the present invention will provide a novel electric guitar, unusually light in weight, with a small body thickness profile, that has a warm feel to the touch, and that has desirable sustain and tone qualities, equal to or greater than electric guitars in predominant use today. The present invention will further provide an electric guitar, with metal parts that does not have intolerable tuning problems.

The present invention operates by constructing an inertial environment on the surfaces where the strings are attached, to simulate an inertial environment that an all metal electric guitar might have at the surfaces where its strings are attached. The brief description of the construction of the present invention, which follows, will make its operation more clear. The guitar body, neck, and head are constructed from a solid material, such as wood, fiberglas, or other non-metallic material. The body may be reduced in thickness to the limit of its structural integrity. Practice shows that a body thickness profile of an inch or less may be used. A metal plate is firmly secured to the top surface of the guitar body at the bridge area, where the strings are to be attached to a bridge or tremolo system. A second metal plate, remote and separate from the first metal plate, is firmly secured to the top surface of the guitar head, where the strings are to be attached to the tuning machines. Both metal plates are subsequently overlayed with a material the same as, or similar to that of which the body is constructed of, in various fashion, to help in securing the plates, and for varied aesthetic effects. The strings are fixed at their proper points of attachment after the aforementioned constructions are completed. The sustain and tone redeeming characteristics gained by constructing an electric guitar in this manner, allows an overall lighter weight and thinner body profile than those weights or profiles that are possessed by electric guitars in predominant use today. No appreciable desirable benefit can be gained in sustain or tone quality characteristics, in the present invention, by increasing body weight, and furthermore, the weight may be reduced further by removing body sections that are not essential for the proper function of the instrument. This reduced weight benefit, in the present invention, does not diminish appreciably the superior sustain and tone quality characteristics of the invention.

BRIEF DESCRIPTION OF THE DRAWINGS

FIG. 1-B is an exploded perspective view of an embodiment of the present invention.

FIG. 11 is an exploded prespective view of the present invention.

FIG. 12 is an isometric view of a guitar head with a metal plate installed.

FIG. 13 is a sectional view as viewed at line 13—13 of FIG. 12.

FIG. 14 is a fragmentary top plan view of a bridge/-tailpiece combination incorporated in the present invention.

FIG. 15 is a sectional view as viewed at line 15—15 of FIG. 14.

FIG. 16 is an exploded fragmentary view of a tremolo system as incorporated in the present invention.

FIG. 17 is a sectional view as viewed at line 17—17 of FIG. 16.

DETAILED DESCRIPTION OF THE INVENTION

Figure 1A:
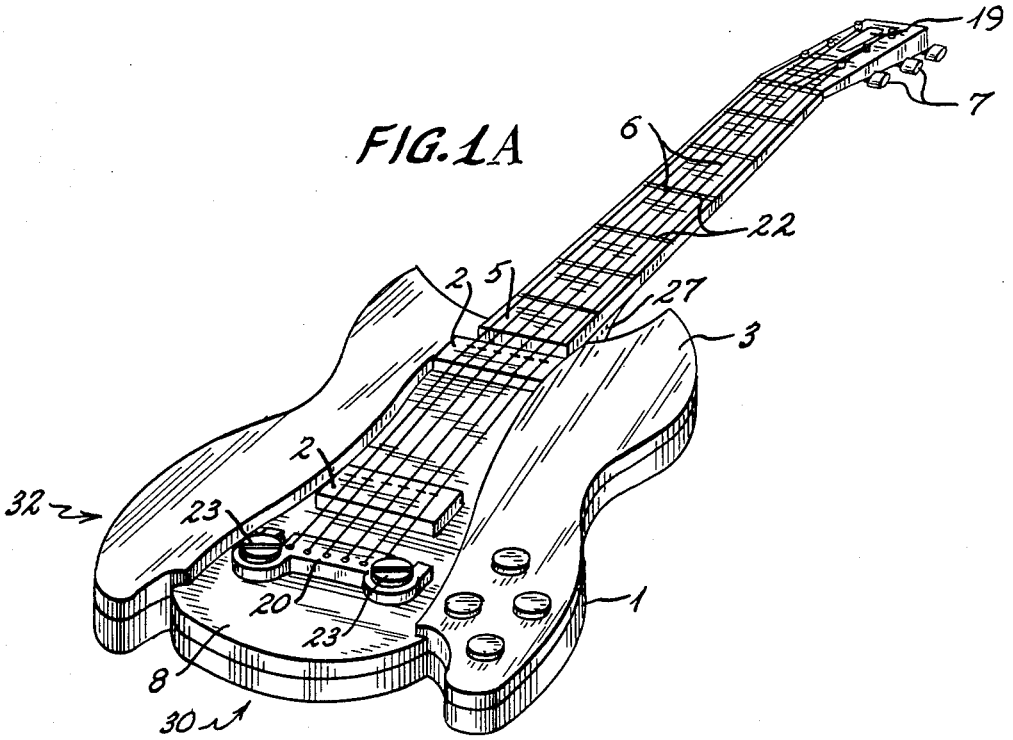
FIG. 1-A is a perspective view of an assembled embodiment of the present invention.
Figure 2:
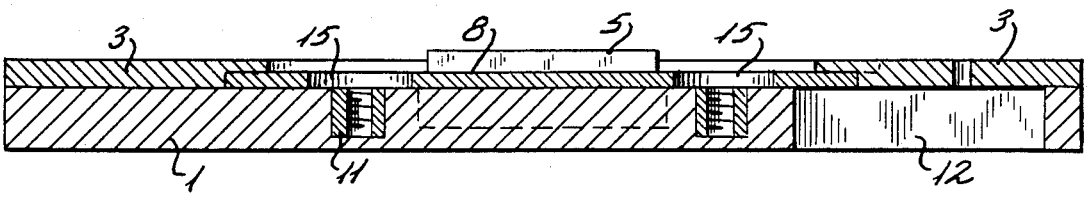
FIG. 2 is a section view as viewed at line II.—II. of FIG. 4.
Figure 3:
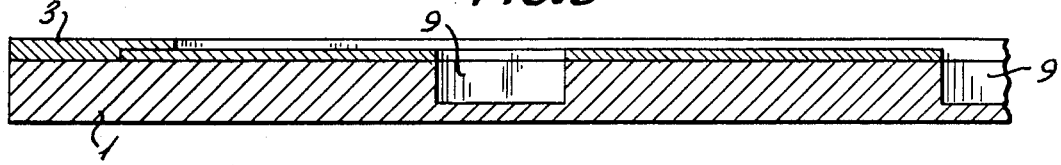
FIG. 3 is a sectional view as viewed at line III.—III. of FIG. 4.
Figure 4:
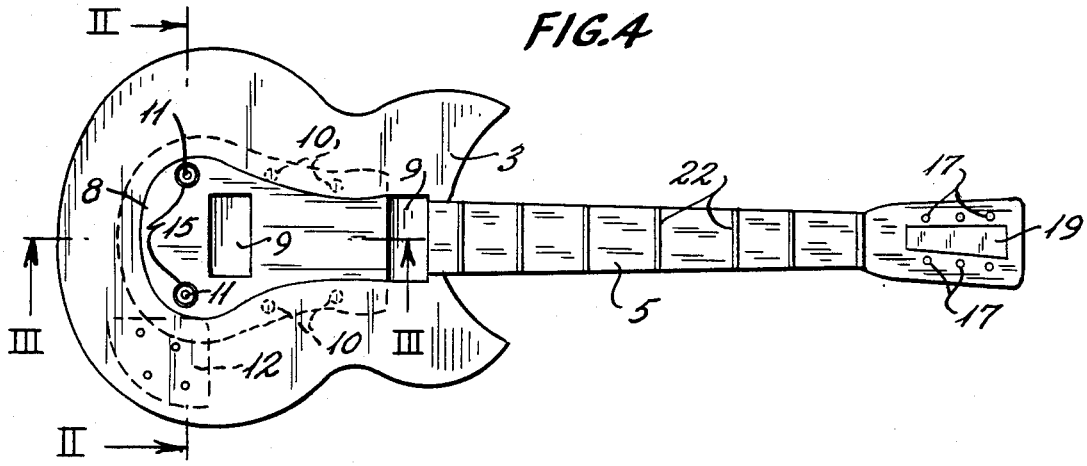
FIG. 4 is a top plan view of the guitar of FIG. 1-B after assembly.
Figure 1B:
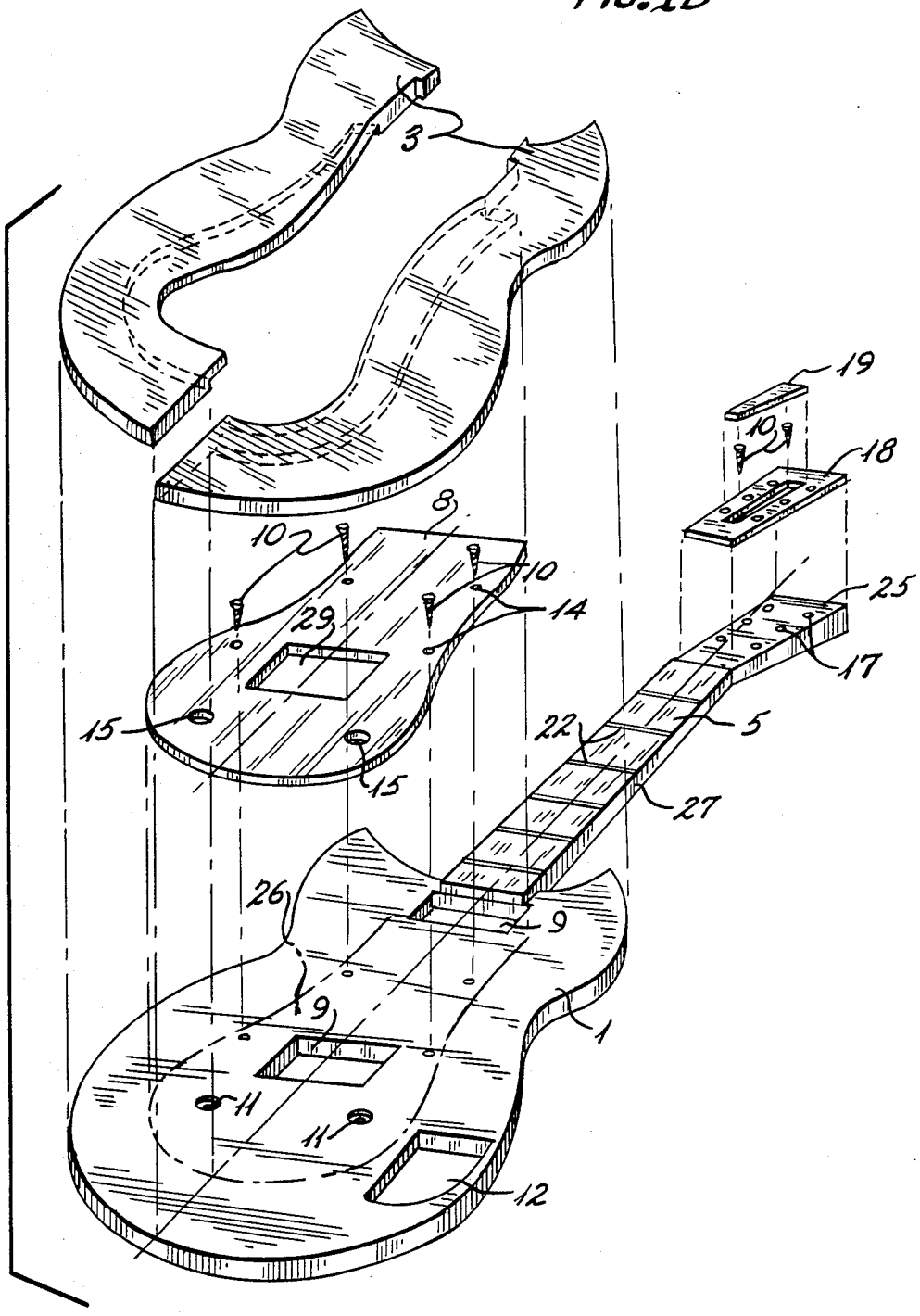
Figure 5:
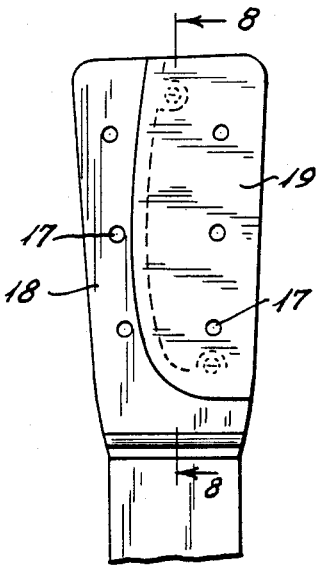
FIGS. 5, 6, and 7 are top plan views of the guitar head for three different configurations of the present invention.
Figure 6:
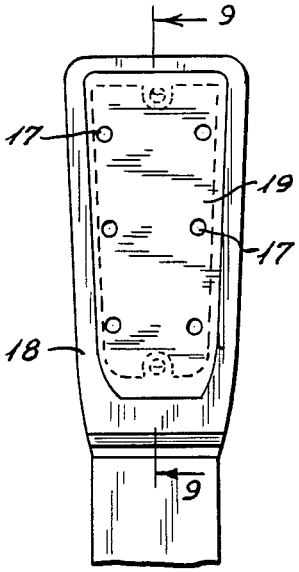
Figure 7:
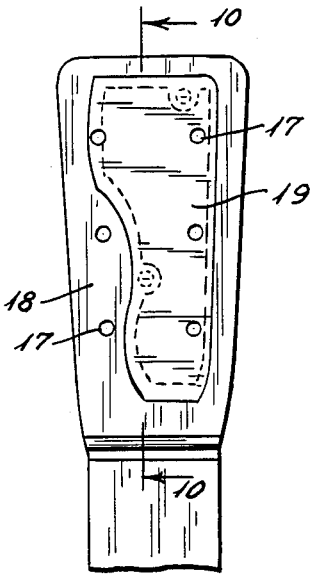
Figure 8:
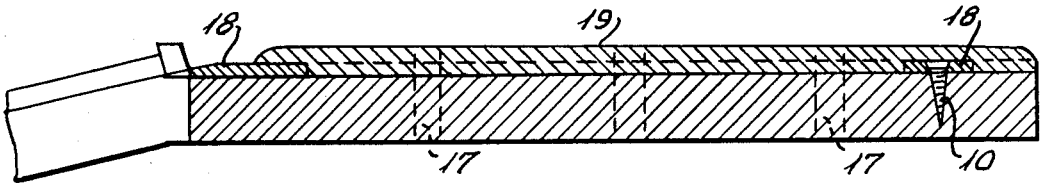
FIG. 8 is a sectional view as viewed at line 8—8 of FIG. 5.
Figure 9:
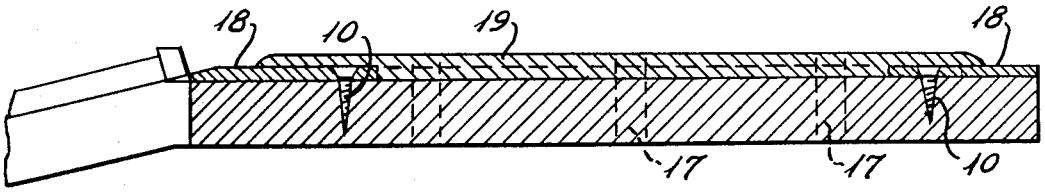
FIG. 9 is a sectional view as viewed at line 9—9 of FIG. 6.
Figure 10:
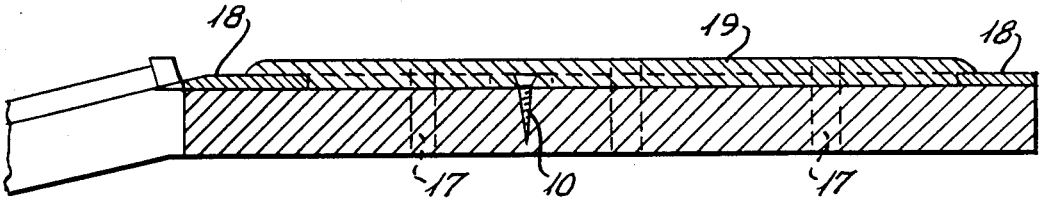
FIG. 10 is a sectional view as viewed at line 10—10 of FIG. 7.

First, looking at FIG. 1-B to comprehend the details of the assembly of the present invention, a body 1 is conventionally constructed of solid material, such as wood, fiberglas, or other non-metallic material. If a wood body 1 is chosen, a conventional fingerboard 5 is cemented to the top of the guitar neck 27 and frets 22 are installed in a conventional manner. Rectanglar receptacle areas 9 are routed on top of the body 1, for receiving conventional electric guitar pickups 2, as shown in FIG. 1-A. A cavity 12 is routed into the body 1 for housing electronic controls, which is conventional in electric guitar construction. Metal inserts 11 containing female threads are installed in the body 1 as is conventional for receiving bridge-holding stud bolts 23, as shown in FIG. 15.

A metal plate 8, preferably brass 3/32 of an inch thick, with a baked on enamel finish to prevent corrosion, is provided with an aperture 29 for receiving an electric guitar pickup 2, said pickup shown in FIG. 1-A. Said metal plate 8 is further provided with holes 14 for wood screw 10 fastening means and larger holes 15 for the bridge-holding stud bolts 23 to pass through without touching the metal plate 18. Said metal plate 8, thus provided is fastened to the site 26 on the body 1 by wood screw 10 means, and suitable cementing means.

The body overlays 3, which for purposes of example could be said to be constructed of solid maple, a quarter of an inch thick, are provided to be fixed to the body 1 by suitable cementing means. The body overlays 3 are routed on their undersides to form-fit over the metal plate 8, so as to allow the body overlays 3 to contact the body 1 surface that remains exposed around the metal plate 8, and be cemented thereto. The body overlays 3, further are allowed by their under-routings, to overlay at least one eighth of an inch of the metal plate's 8 adjacent periphery, so as to be pleasing aesthetically, as well as helping to secure the metal plate 8.

As an alternate method of installing the metal plate 8, observe FIG. 11. The metal plate 8 to be secured to the body 1, may be installed into a recessed area 24, routed into the body 1. The recessed area 24 supports the metal plate 8, to a depth that allows the top of the plate 8 to be even with the unrouted remainder to the top surface of the body 1. The plate 8 is secured into the recessed area 24 by wood screw 10 means, as well as, suitable cementing means. The top overlays 3 for the body 1, in this method, do not require under-routings to fit over the metal plate 8. These body overlays 3, lie flatly on, and are cemented to the top surface of the body 1, that remains unrouted around the metal plate 8. The body overlays 3, also overlay at least one eighth of an inch of the metal plate's 8 proximal periphery. The body overlays 3 need not be cemented to the metal plate 8, when a relatively small portion of the metal plate 8 is overlayed.

Now referring to FIG. 1-B and FIGS. 5,6,7,8,9, and 10, a second metal plate 18 is secured to the top surface of the guitar head 25 by wood screw 10 means, and suitable cementing means. The area not covered by the second metal plate 18 leaves some of the top surface of the guitar head 25 exposed. The head overlay 19, overlays at least one eighth of an inch of the second metal plate's 18 adjacent border and is routed to allow the head overlay 19 to contact and be cemented to the portion of the guitar head 25 surface that is not covered by the second metal plate 18.

The present invention, assembled in the aforementioned manner, will further be furnished with conventional fixtures for electric guitars. Ref. FIGS. 1-A and 1-B, the electric pickup 2, nearest the neck is installed into aperture 9. The electric pickup 2, nearest the bridge, is installed through the aperture 29 in the metal plate 8, and into the aperture 9 of the body 1. Bridge-holding stud bolts 23 are directed through the clearance holes 15 in the metal plate 8, into the threaded inserts 11, without touching the metal plate 8. This is to avoid temperature related expansional changes in the metal plate 8 that could be transferred to the bridge-holding stud bolts 23 causing tuning problems. The bridge/tailpiece combination 20, referring to FIGS. 14 and 15, is now installed on the bridge-holding stud bolts 23. Now referring to FIGS. 16 and 17, if a tremolo system 21 is used for string attachment on the body 1 end of the present invention, the tremolo-holding screws 31, should pass through the clearance holes 15 in the metal plate 8 and be anchored in the body 1, below the metal plate 8, without touching the metal plate 8. This also is to avoid temperature related expansional changes in the metal plate 8, that could be transferred to the tremolo-holding screws 31, causing tuning problems.

The strings 6 are attached to the bridge/tailpiece combination 29, or tremolo system 21, in a conventional manner, and are tensioned across the body 1, to the neck 27 and further along the neck 27 and attached, according to convention, to tuning machines 7, which are fixed in the holes 17 in the guitar head 25.

The weight of the present invention should be reduced further, in order to construct the invention in its best contemplated mode. This further weight reduction is to be accomplished by excluding a section from a conventional guitar shape that is a non-essential area 30 for the proper function of the guitar of the present invention. This non-essential area 30 includes all of the area beyond the bridge/tailpiece combination 20, at the body end remote from the guitar head 25, that may be excluded without threatening the structural integrity of the bridge/tailpiece combination 20, the cavity 12 that houses the electronic controls, or the player's right arm resting area 32.

The present invention, now described, obviously lends itself to further modifications and alterations by those skilled in the art, without the necessity of departing from the scope of the invention.

What is claimed is:

1. An electric guitar comprising:

(a) a solid body, having an elongate neck extending away from one end of said body, a head formed at the end of said neck remote from said body end;

(b) a metal plate provided with an aperture for receiving electric pickup means, said metal plate also being provided with clearance holes for string fastening threaded holding means, said metal plate being firmly secured to the top surface of said body, and said metal plate being overlayed with a material that is less dense than that of which said metal plate is constructed;

(c) a second metal plate, remote and separate from said first metal plate on said body end, and second metal plate being firmly secured to the top surface of the guitar head and said second metal plate being overlayed with a material that is less dense than that of which said second metal plate is constructed;

(d) a plurality of strings attached to string fastening means on said body end, said strings being tensioned across said body to said neck and being attached to tuning machines, said tuning machines being fixed in holes in said head-said second metal plate-said overlay construction;

(e) electric pickup sensing means to electrically sense the vibrations of said string; and (f) a cavity in said body to house electronic controls.

2. The invention as claimed in claim 1, in which said first metal plate on said body end is firmly secured into a recessed area of said body top surface, said recessed area being routed to a depth that supports said first metal plate's top surface even with the top surface of said body.

3. The invention as claimed in claim 1, in which said second metal plate firmly secured to the top surface of said guitar head is constructed to cover all of said guitar head top surface.

4. The invention as claimed in claim 1, in which said string fastening threaded holding means does not touch said clearance holes in said first metal plate as said string fastening threaded holding means passes through said clearance holes to be anchored in said body.

5. The invention as claimed in claim 4, in which said second metal plate firmly secured on the top surface of said guitar head is constructed to cover a border area of a half inch or less of said top surface of said guitar head.

6. The invention as claimed in claim 5 in which said string fastening means is a tremolo system.

7. The invention as claimed in claim 4 in which said second metal plate firmly secured upon the top surface of said guitar head is constructed to cover a border area of a half inch or less, as well as, 50% or less of the remaining inbounded uncovered area of said top surface of said guitar head.

8. The invention as claimed in claim 7 in which said string fastening means is a bridge/tailpiece combination.

9. The invention as claimed in claim 1 in which said second metal plate firmly secured to the top surface of said guitar head is constructed to cover 75% or less of said guitar top surface.

* * * * *